US008112283B2

(12) United States Patent
Ise

(10) Patent No.: US 8,112,283 B2
(45) Date of Patent: Feb. 7, 2012

(54) IN-VEHICLE AUDIO APPARATUS

(75) Inventor: Tomohiko Ise, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 794 days.

(21) Appl. No.: 11/296,856

(22) Filed: Dec. 7, 2005

(65) Prior Publication Data

US 2006/0147055 A1 Jul. 6, 2006

(30) Foreign Application Priority Data

Dec. 8, 2004 (JP) ..... 2004-355531

(51) Int. Cl.
*G10L 21/00* (2006.01)

(52) U.S. Cl. ..... 704/270.1; 704/233; 704/226; 704/207; 455/550.1; 381/94.7; 381/94.3; 381/94.2; 381/95

(58) Field of Classification Search ..... 704/233, 704/226, 207, 270.1; 381/94.3, 94.7, 94.2, 381/95; 455/550.1
See application file for complete search history.

(56) References Cited

U.S. PATENT DOCUMENTS

| | | | | |
|---|---|---|---|---|
| 5,677,960 | A | 10/1997 | Unno et al. | |
| 6,044,341 | A * | 3/2000 | Takahashi | 704/226 |
| 6,108,621 | A * | 8/2000 | Nishiguchi et al. | 704/207 |
| 6,122,384 | A * | 9/2000 | Mauro | 381/94.3 |
| 6,202,046 | B1 * | 3/2001 | Oshikiri et al. | 704/233 |
| 7,043,428 | B2 * | 5/2006 | Li | 704/233 |
| 2001/0000190 | A1 * | 4/2001 | Oshikiri et al. | 704/233 |
| 2001/0021905 | A1 * | 9/2001 | Burnett et al. | 704/233 |
| 2002/0103643 | A1 * | 8/2002 | Rotola-Pukkila et al. | 704/233 |
| 2003/0003944 | A1 * | 1/2003 | Rosenzweig | 455/550 |
| 2003/0128851 | A1 * | 7/2003 | Furuta | 381/94.2 |
| 2004/0037439 | A1 * | 2/2004 | Ise et al. | 381/94.3 |
| 2004/0057586 | A1 * | 3/2004 | Licht | 381/94.7 |

FOREIGN PATENT DOCUMENTS

JP 58-73622 5/1983

OTHER PUBLICATIONS

Office Action issued by the Japanese Patent Office in corresponding JP Application No. 2004-355531 and English translation thereof.

* cited by examiner

*Primary Examiner* — Michael Colucci
(74) *Attorney, Agent, or Firm* — Brinks Hofer Gilson & Lione

(57) ABSTRACT

An audio apparatus has a function of correcting an audio signal in response to a noise level. The audio apparatus includes a correction unit that corrects an input audio signal on the basis of a weighting factor, an output unit that produces a played-back audio sound on the basis of the corrected audio signal, a microphone for receiving an external sound that includes the played-back audio sound and noise, a noise-extracting unit that extracts a noise signal from an external sound signal, the noise-extracting unit including a speech-removing unit that removes a speech signal from the noise signal on the basis of noise spectrum data, and a weighting factor calculation unit that calculates the weighting factor on the basis of the extracted noise signal and supplies the calculated weighting factor to the correction unit.

12 Claims, 6 Drawing Sheets

IN-VEHICLE AUDIO APPARATUS

BACKGROUND OF THE INVENTION

1. Field of the Invention

The present invention relates to in-vehicle audio apparatuses, and in particular, relates to a method for correcting audio signals in response to the level of noise that occurs in a vehicle that is being driven.

2. Description of the Related Art

In a case where a passenger listens to music through a compact disk (CD), a digital versatile disk (DVD), a radio broadcast, or the like in a vehicle cabin, when the passenger is exposed to background noise, such as an engine noise or a road noise, the passenger cannot hear music in a satisfactory condition. In view of this problem, a system exists in which the noise level is measured with a microphone provided in the vehicle cabin and an optimum correction (for example, correction of the volume) is performed in response to the noise level. Specifically, in this system, a microphone is used to collect sound in a vehicle cabin, and audio signals in external sound signals received by the microphone are cancelled to extract noise.

An apparatus that automatically adjusts the volume in response to noise is disclosed in Japanese Unexamined Patent Application Publication No. 10-335960. This apparatus includes a noise-signal extracting unit that extracts only noise signals from sound signals in a vehicle cabin detected by a microphone and a volume-adjusting unit that adjusts the volume of an audio apparatus in response to the noise signals detected by the noise-signal extracting unit, and this apparatus enables a passenger to hear audio signals from an audio signal source at an appropriate volume in consideration of the noise level in the vehicle cabin.

However, in the known in-vehicle audio apparatus, although played-back music can be distinguished from noise, a speech sound of a person in a vehicle cabin cannot be distinguished. Thus, correction is performed on noise that includes a speech sound. The frequency spectrum and volume of a speech sound of a person can suddenly and markedly change. Thus, when audio signals are corrected on the basis of the level of noise that includes a speech sound, a change in the amount of correction is inevitably large, resulting in an unnatural sound.

SUMMARY OF THE INVENTION

In view of the aforementioned problem, it is an object of the present invention to provide an audio apparatus that can remove a speech sound from noise and correct an audio signal.

An audio apparatus according the present invention has a function of correcting an audio signal in response to a noise level. The audio apparatus includes a correction unit that corrects an audio signal on the basis of a weighting factor, an output unit that produces a played-back audio sound on the basis of the corrected audio signal, a microphone for receiving an external sound that includes the played-back audio sound and noise, a noise-extracting unit that extracts a noise signal from an external sound signal detected by the microphone, the noise-extracting unit including a speech-removing unit that removes a speech signal from the noise signal on the basis of noise spectrum data that is prepared in advance, and a weighting factor calculation unit that calculates the weighting factor on the basis of the extracted noise signal and supplies the calculated weighting factor to the correction unit.

Moreover, a method for playing back an audio signal in an in-vehicle audio apparatus includes receiving an external sound that includes a played-back audio sound and noise in a vehicle interior space through a microphone, extracting a noise signal from an external sound signal detected by the microphone and removing a speech signal from the extracted noise signal with reference to noise spectrum data, calculating a weighting factor corresponding to the noise signal from which the speech signal is removed, correcting the audio signal on the basis of the calculated weighting factor, and producing the played-back audio sound on the basis of the corrected audio signal.

In the audio apparatus according to the present invention, a speech sound is removed from noise on the basis of noise spectrum data, and an audio signal is corrected on the basis of the noise from which the speech sound is removed. Thus, a played-back audio sound having a sound quality suitable for an actual noise level can be obtained by suppressing the influence of a speech sound in which a sudden change in the frequency or volume occurs.

The audio apparatus according to the present invention can be used in a navigation apparatus or a navigation system that includes an in-vehicle audio unit, in-vehicle electronic equipment that receives a radio broadcast or a television broadcast, or the like.

DETAILED DESCRIPTION OF THE DRAWINGS AND THE PRESENTLY PREFERRED EMBODIMENTS

Audio apparatuses according to embodiments of the present invention will now be described in detail with reference to the drawings. The audio apparatuses according to the embodiments of the present invention are preferably embodied in in-vehicle audio apparatuses or in-vehicle audio systems.

Embodiments

Figure 1:
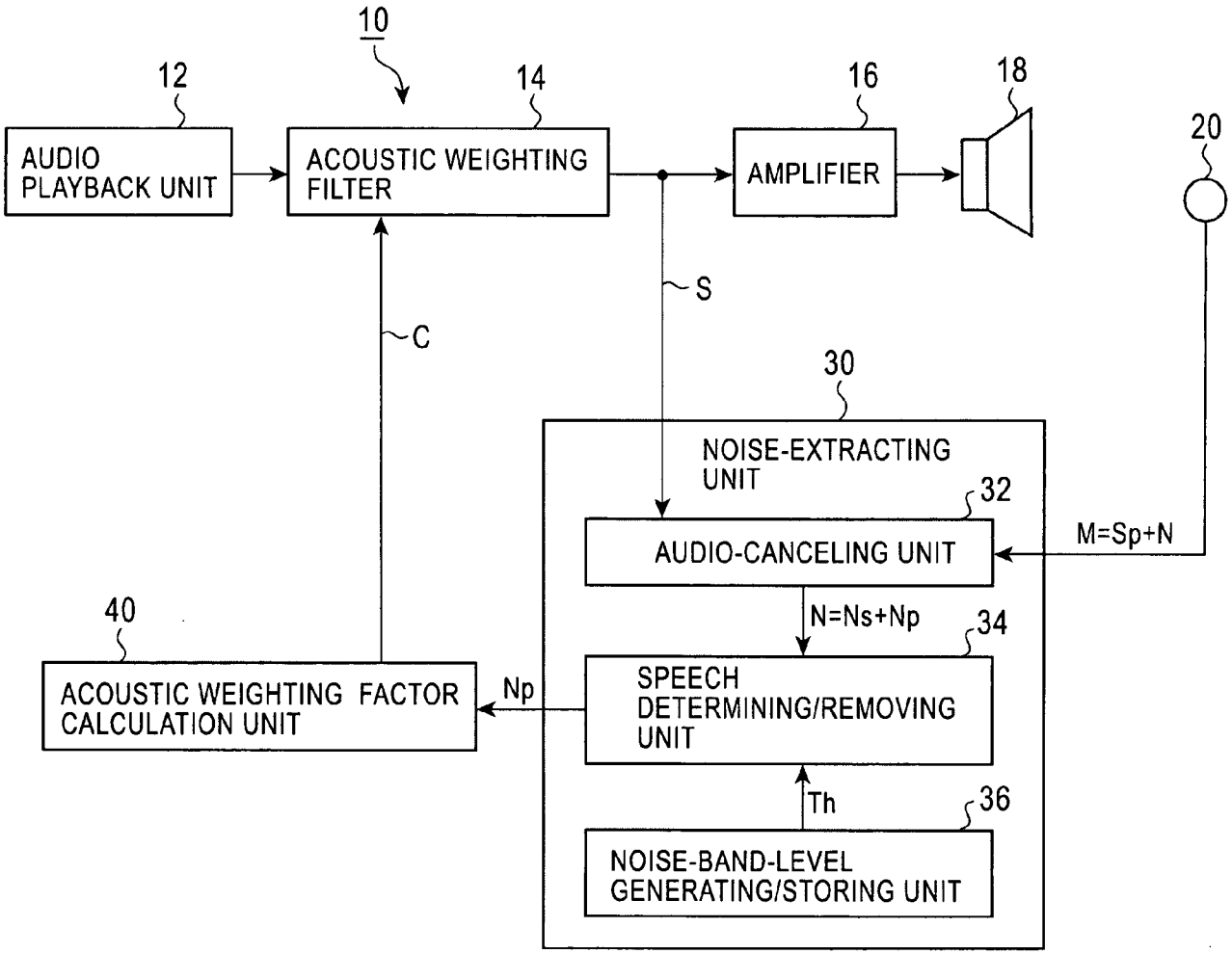
FIG. 1 is a block diagram showing the structure of an in-vehicle audio apparatus according to a first embodiment of the present invention.

In the present invention, noise of a vehicle that is being driven is distinguished from a speech sound of a person on the basis of the difference between spectra of the noise and the speech sound so that correction is not performed on the speech sound. FIG. 1 is a block diagram showing the structure of an in-vehicle audio apparatus according to a first embodiment of the present invention. The in-vehicle audio apparatus 10 includes an audio playback unit 12 that generates audio signals corresponding to data stored in, for example, a CD or a DVD, or audio signals from a radio broadcast or a television broadcast, an acoustic weighting filter 14 that receives the audio signals from the audio playback unit 12 as input and corrects the audio signals for the frequency characteristics, the volume, or the like on the basis of an acoustic weighting factor C, an amplifier 16 that amplifies the corrected audio signals, and a speaker 18 that produces the amplified audio signals in a vehicle interior space as an audible sound.

The in-vehicle audio apparatus 10 further includes a microphone 20 for receiving an external sound in a vehicle interior space, a noise-extracting unit 30 that receives external sound signals M detected by the microphone 20 as input and extracts noise signals from the external sound signals M, and an acoustic weighting factor calculation unit 40 that calculates the acoustic weighting factor C on the basis of the noise signals extracted by the noise-extracting unit 30 and provides the calculated acoustic weighting factor C to the acoustic weighting filter 14.

In an acoustic space of a vehicle, sound of conversation among passengers and a driving noise, such as an engine noise and a road noise, which occurs in a vehicle that is being driven, are mixed with a played-back audio sound produced from the speaker 18. These mixed sounds are received by the microphone 20 as an external sound. Thus, the external sound signals M detected by the microphone 20 include played-back audio signals Sp and noise signals N (M=Sp+N). The noise signals N include speech signals Ns and other driving noise signals Np (N=Ns+Np).

The noise-extracting unit 30 according to this embodiment includes an audio-canceling unit 32, a speech determining/removing unit 34, and a noise-band-level generating/storing unit 36. The audio-canceling unit 32 receives audio signals S from the acoustic weighting filter 14 and the external sound signals M (M=Sp+N) from the microphone 20 as inputs and cancels the played-back audio signals Sp on the basis of the difference between the audio signals S and the external sound signals M. At this time, the audio-canceling unit 32 corrects the audio signals S with transfer characteristics H of audio signals in an acoustic space of a vehicle so that Sp=H·S. Thus, the played-back audio signals Sp are removed from the external sound signals M and the noise signals N (N=Ns+Np) are extracted.

The speech determining/removing unit 34 receives the noise signals N from the audio-canceling unit 32, reads threshold values Th from the noise-band-level generating/storing unit 36, and compares the noise signals N with the threshold values Th to determine whether the noise signals N include the speech signals Ns. The speech determining/removing unit 34 removes the speech signals Ns from the noise signals N upon determining that the noise signals N include the speech signals Ns. In this way, the driving noise signals Np are extracted and supplied to the acoustic weighting factor calculation unit 40.

Figure 2:
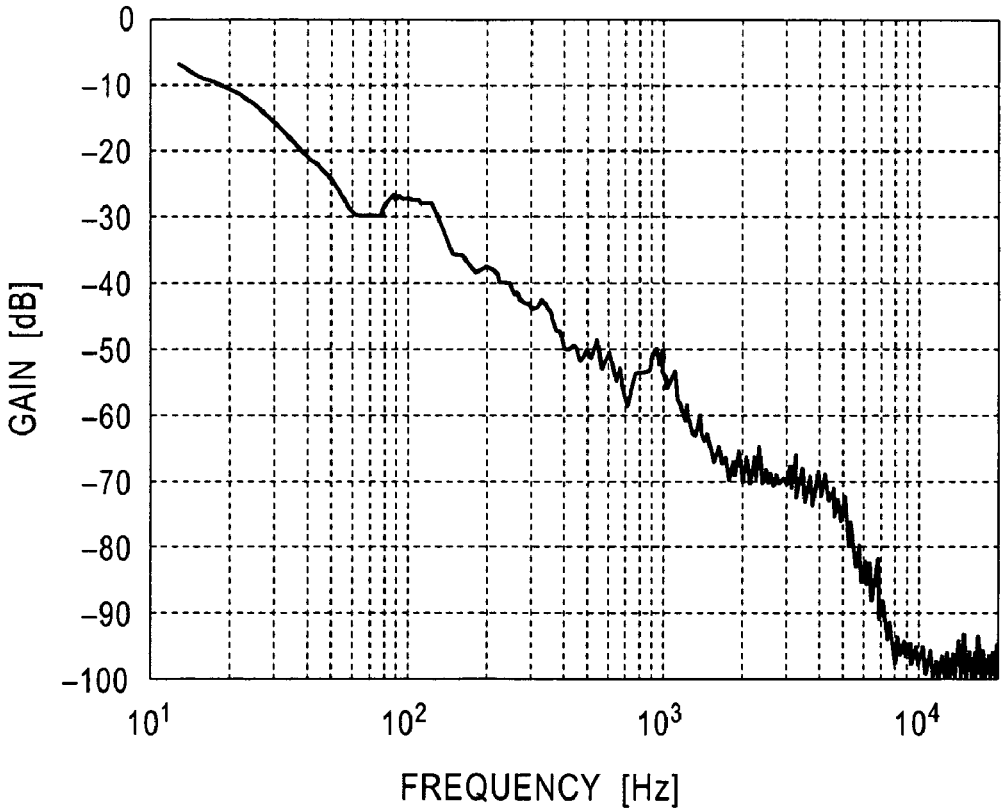
FIG. 2 is a graph showing the noise spectrum of a vehicle that is being driven.

The noise-band-level generating/storing unit 36 generates the threshold values Th on the basis of the noise spectrum data that is prepared in advance and stores the threshold values Th in a memory or the like. For example, the noise spectrum of a vehicle as shown in FIG. 2 can be used as the noise spectrum data. This noise spectrum represents typical frequency characteristics of noise that occurs in a vehicle that is being driven. In FIG. 2, the abscissa indicates a frequency (represented on a logarithmic scale), and the ordinate indicates a gain (represented in units of decibels). It can be seen that a driving noise of a vehicle is large at low frequencies (bass) and gradually decreases as the frequency becomes higher in this noise frequency spectrum.

Figure 3A:
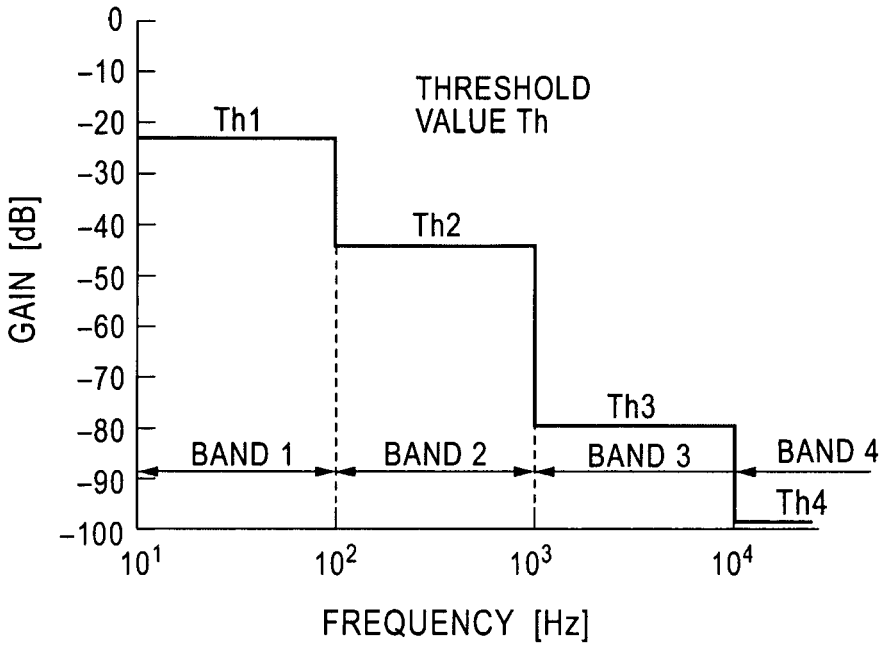
FIG. 3A shows threshold values that are generated for individual frequency bands having a predetermined bandwidth on the basis of the noise spectrum.

The noise-band-level generating/storing unit 36 generates the threshold values Th for individual predetermined frequency bands on the basis of the noise spectrum shown in FIG. 2. For example, as shown in FIG. 3A, average gains Th1, Th2, Th3, and Th4 of the noise spectrum shown in FIG. 2 are calculated for corresponding frequency bands 1 to 4 having ranges of 10 to 100 Hz, 100 Hz to 1 kHz, 1 kHz to 1 GHz, and greater than or equal to 1 GHz, respectively, and these average gains are set as the threshold values Th.

Figure 3B:
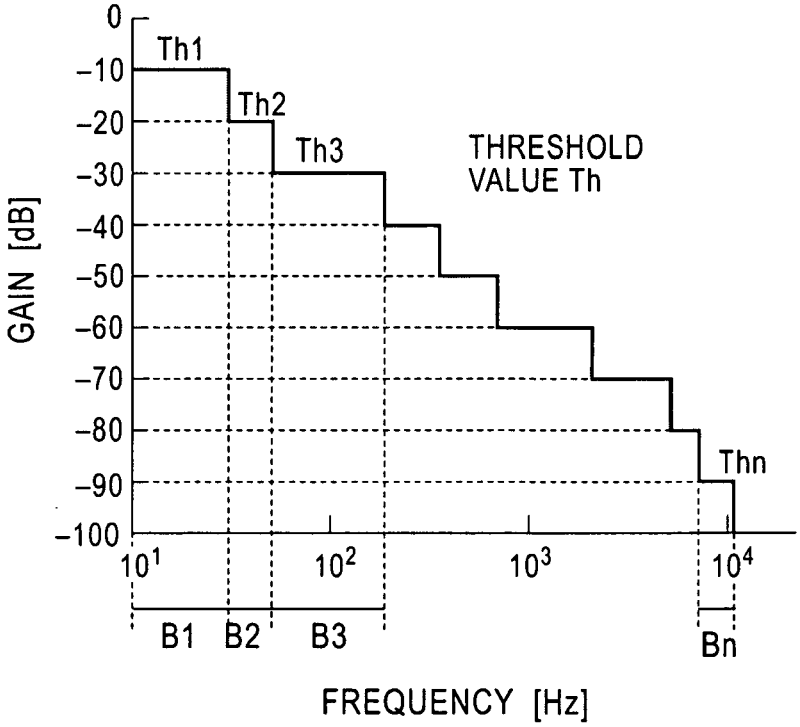
FIG. 3B shows threshold values that are generated for individual frequency bands on the basis of the noise spectrum so that a gain decreases by a predetermined value.

Alternatively, average gains of the noise spectrum shown in FIG. 2 may be calculated for bands 1 to n so that the average values decrease by 10 dB, as shown in FIG. 3B, and these average gains may be set as threshold values Th1 to Thn for the corresponding bands 1 to n.

Figure 4:
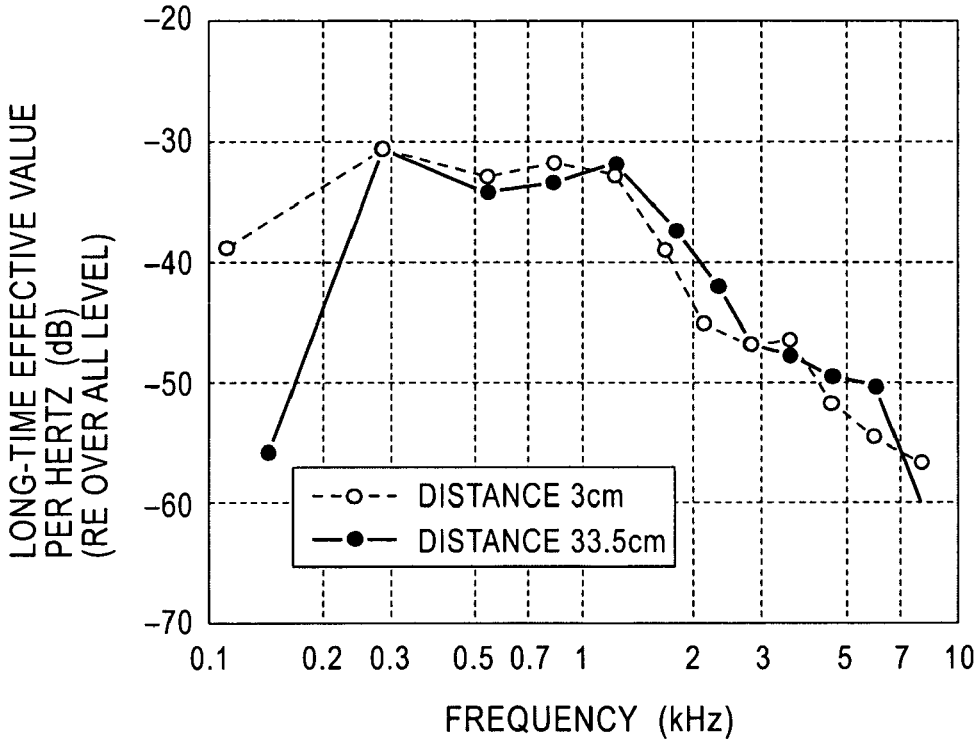
FIG. 4 is a graph showing a speech spectrum.

On the other hand, the voice of a person has the speech spectrum shown in FIG. 4. In FIG. 4, the abscissa indicates a frequency (represented in units of kilohertz), and the ordinate indicates a long-time effective value per hertz (represented in units of decibels). A solid line indicates the spectrum at a distance of 33.5 cm, and a dashed line indicates the spectrum at a distance of 3 cm. It can be seen from the drawing that the long-time effective value per hertz reaches a peak at middle frequencies and is small at low and high frequencies in the speech spectrum.

The noise signals N extracted by the audio-canceling unit 32 include the speech signals Ns and the driving noise signals Np. That is to say, the noise signals N are based on a spectrum that is obtained by superimposing the speech spectrum shown in FIG. 4 on the spectrum of driving noise shown in FIG. 2. The speech determining/removing unit 34 compares the superimposed noise signals N with the threshold values Th for the individual frequency bands. When the noise signals N exceed a threshold value Th for each frequency band, the speech determining/removing unit 34 determines that the noise signals N include the speech signals Ns, and replaces the noise signals with the threshold value Th for each frequency band. In this way, the speech signals Ns are removed from the noise signals N.

The acoustic weighting factor calculation unit 40 calculates an appropriate acoustic weighting factor C on the basis of the driving noise signals Np extracted by the noise-extracting unit 30 and provides the calculated acoustic weighting factor C to the acoustic weighting filter 14.

Figure 5:
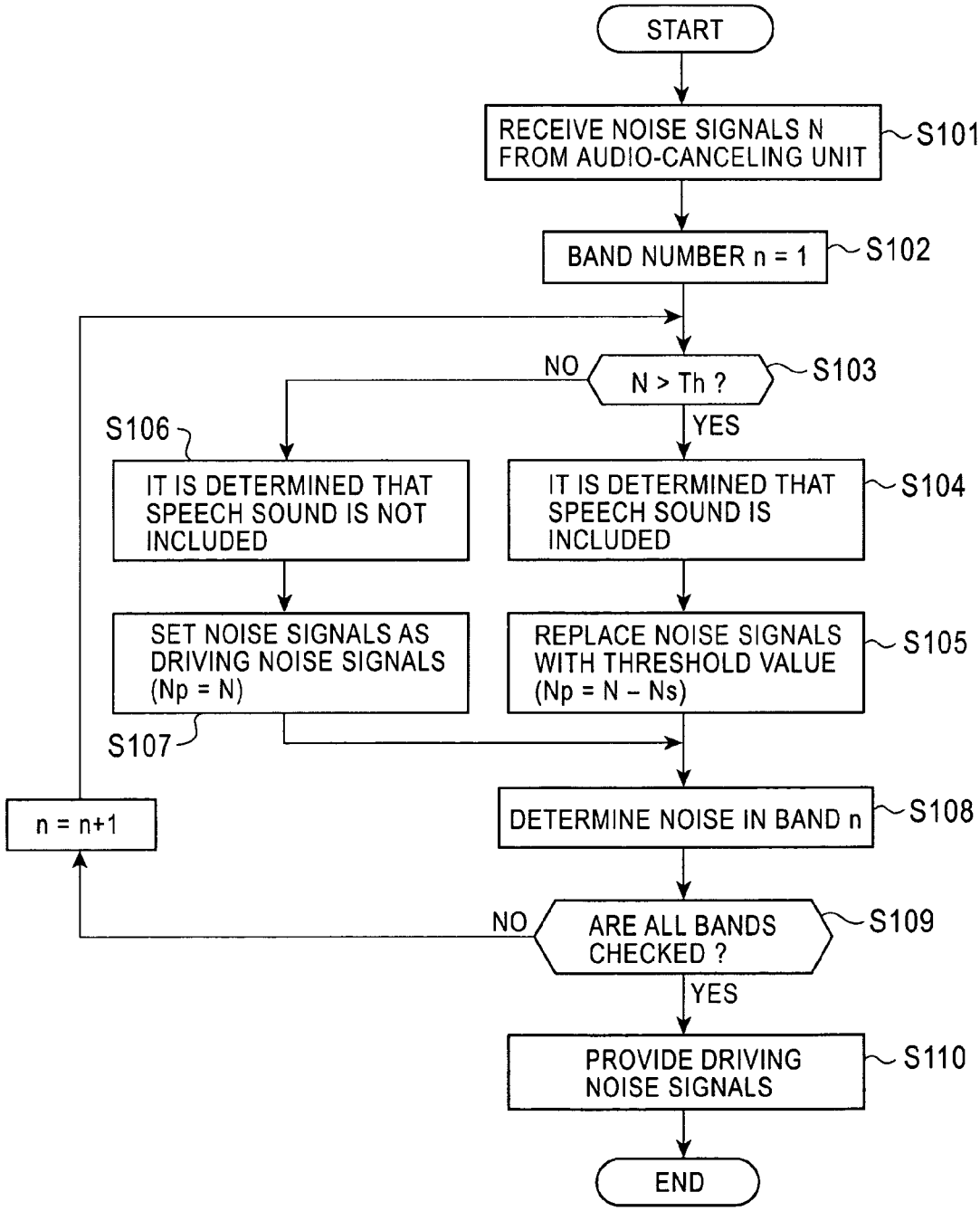
FIG. 5 is a flowchart showing the operation of the audio apparatus according to the first embodiment.

The operation of the speech determining/removing unit 34 in the noise-extracting unit 30 will now be described with reference to a flowchart of FIG. 5. It is assumed that a played-back audio sound is produced from the speaker 18 and an external sound in the vehicle interior space is received by the microphone 20 when a vehicle is being driven. When the speech determining/removing unit 34 receives the noise signals N from the audio-canceling unit 32 in step S101, the speech determining/removing unit 34 determines for individual frequency bands whether the noise signals N include the speech signals Ns and performs other processes. In this case, the band level is sequentially increased from band 1 to n in order.

In step S102, the speech determining/removing unit 34 selects the lowest band level, i.e., band 1, as the first band level at which the speech determining/removing unit 34 determines whether the noise signals N include the speech signals Ns. In step S103, the speech determining/removing unit 34 compares the noise signals N in band 1 with a threshold value Th corresponding to band 1. When the noise signals N exceed the threshold value Th, it is determined that the noise signals N include the speech signals Ns in step S104, and the noise signals N are replaced with the threshold value Th in step S105. On the other hand, when the noise signals N are equal to or less than the threshold value Th, it is determined that the noise signals N do not include the speech signals Ns in step S106, and the noise signals N are set as the driving noise signals Np (Np=N) in step S107. Then, noise is determined and extracted in band 1 in step S108.

Subsequently, it is determined in step S109 whether noise is determined and extracted in all of the bands, and steps S103 to S108 are repeated for band 2 and the succeeding bands. When noise has been determined and extracted in all of the bands, the speech determining/removing unit 34 provides the driving noise signals Np to the acoustic weighting factor calculation unit 40 in step S110.

In the in-vehicle audio apparatus according to this embodiment, a system for correcting audio signals can be achieved which is insensitive to a speech sound in a loud environment.

A second embodiment according to the present invention will now be described. In the aforementioned embodiment, the noise signals N are compared with a threshold value Th in a corresponding frequency band to determine whether the noise signals N include the speech signals Ns. On the other hand, in the second embodiment, the noise signals N in one frequency band are compared with those in another frequency band that is one level lower than the one frequency band. The spectrum of the speech sound has a peak in a middle frequency range, as described above. Thus, when the speech spectrum shown in FIG. 4 is superimposed on the noise spectrum shown in FIG. 2, a decrease in a gain of the noise signals N is moderate from a low frequency range to a middle frequency range. The speech spectrum has the peak in a frequency range of about 300 Hz to 1 kHz, and a decrease in a gain of the noise signals N is moderate in this frequency range.

For example, in a case where the frequency range of 300 Hz to 1 kHz is divided into bands b1 to bn having a predetermined bandwidth, it is determined whether the difference between noise signals N2 in band b2 and noise signals N1 in band b1, which is one level lower than band b2, exceeds a threshold value. When the difference is less than the threshold value, a decrease in a gain of the noise is moderate. Thus, it is determined that the noise includes the speech sound, and the noise signals N2 are replaced with the noise signals N1. When the difference exceeds the threshold value, it is determined that the noise does not include the speech sound, and the noise signals N2 are set as the driving noise signals Np.

Figure 6:
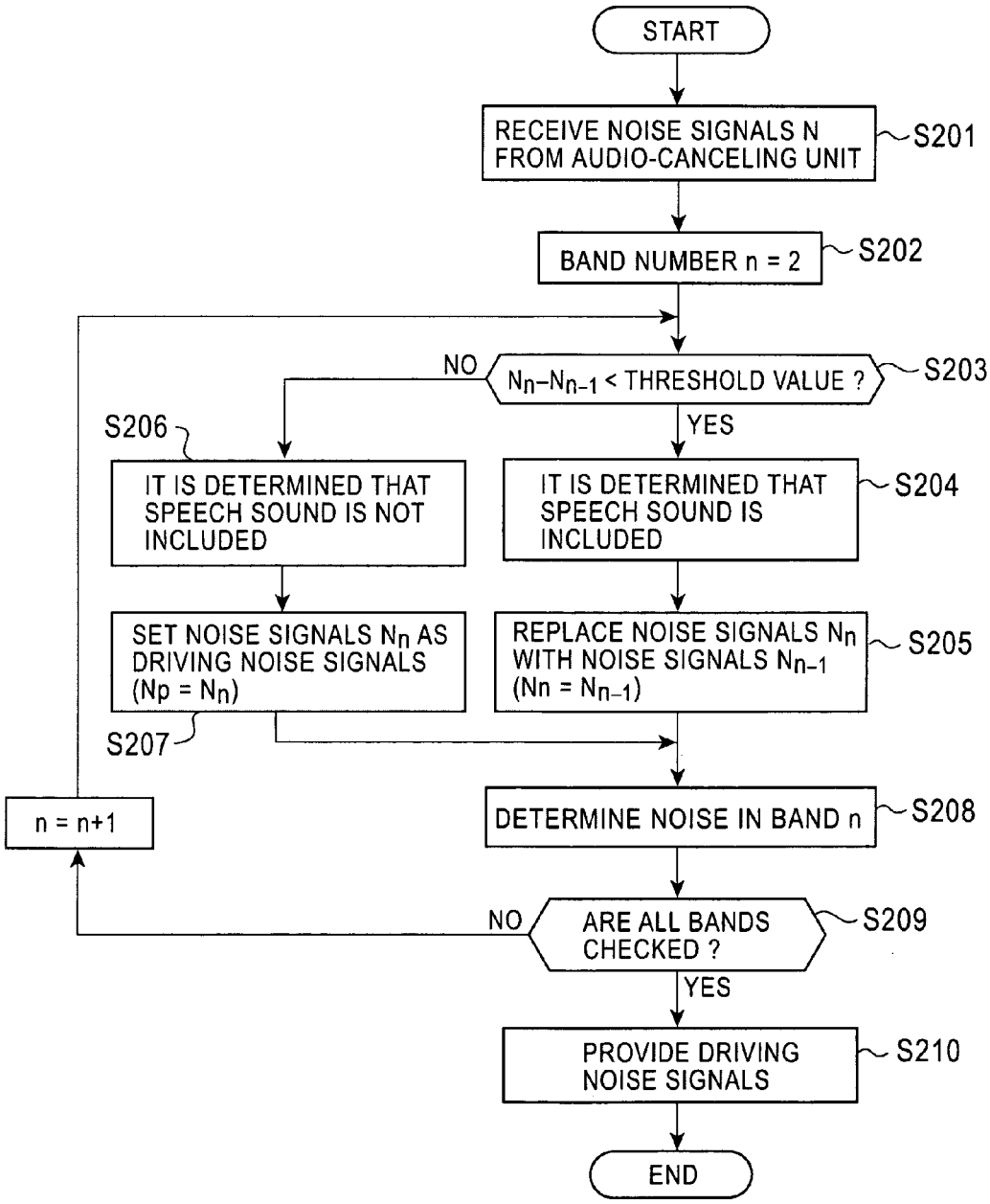
FIG. 6 is a flowchart showing the operation of an audio apparatus according to a second embodiment of the present invention.

FIG. 6 is a flowchart showing the operation of the second embodiment. When the speech determining/removing unit 34 receives the noise signals N from the audio-canceling unit 32 in step S201, the speech determining/removing unit 34 selects a low band level, i.e., band 2, as the first band level at which the speech determining/removing unit 34 determines whether the noise signals N include the speech signals Ns in step S202. In step S203, the speech determining/removing unit 34 compares the difference between noise signals N2 in band 2 and noise signals N1 in band 1 with a threshold value. The noise signals N1 and N2 are averages in bands 1 and 2, respectively. The threshold value is an adjustment factor which can be adjusted for individual vehicles.

When the difference between the noise signals N2 and the noise signals N1 is less than the threshold value, it is determined that the noise signals N2 include the speech signals Ns in step S204, and the noise signals N2 are replaced with the noise signals N1 in step S205. On the other hand, when the difference between the noise signals N2 and the noise signals N1 is equal to or more than the threshold value, it is determined that the noise signals N2 do not include the speech signals Ns in step S206, and the noise signals N2 are set as the driving noise signals Np (Np=N2) in step S207. Then, noise is determined and extracted in band 2 in step S208.

Subsequently, it is determined in step S209 whether noise is determined and extracted in all of the bands, and steps S203 to S208 are repeated for band 3 and the succeeding bands. When it is determined that noise has been determined and extracted in all of the bands, the speech determining/removing unit 34 provides the driving noise signals Np to the acoustic weighting factor calculation unit 40 in step S210.

In the process described above, the middle frequency range of the noise signals can be removed. Thus, the speech signals can be removed from the noise signals so that correction is not performed on the speech signals.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An audio apparatus for correcting an audio signal in response to a noise level, the audio apparatus comprising:

a correction unit configured to correct an input audio signal on the basis of a weighting factor;

an output unit that produces a played-back audio sound on the basis of the corrected input audio signal;

a microphone for receiving an external sound, which includes the played-back audio sound and a noise signal, the noise signal including a speech signal and a driving noise signal;

a noise-extracting unit configured to extract the noise signal from the external sound detected by the microphone, the noise-extracting unit including:

an audio-cancelling unit configured to remove the input audio signal from the played-back audio sound and noise signal;

a speech-determining unit configured to identify and isolate the speech signal included in the noise signal on the basis of predetermined noise spectrum data having a plurality of frequency bands corresponding to a noise spectrum of vehicle noise present in a vehicle cabin, wherein a lower frequency band and an adjacent upper frequency band form a frequency band pair;

a speech-removing unit configured to compare noise signal levels in the lower frequency band and the upper frequency band of each of a plurality of frequency band pairs, and if the difference in the respective noise levels in a frequency band pair is greater than a noise difference threshold value, the noise signal is replaced with the noise difference threshold value, so as to eliminate the speech signal from the noise signal in the frequency band pair, to thereby generate an extracted noise signal free of the speech signal; and a weighting factor calculation unit configured to calculate the weighting factor on the basis of the extracted noise signal, and configured to supply the calculated weighting factor to the correction unit.

2. The audio apparatus according to claim 1, wherein the correction unit corrects a gain of the audio signal on the basis of the weighting factor.

3. The audio apparatus according to claim 1, wherein the threshold value is set for individual frequency bands of the noise spectrum data.

4. The audio apparatus according to claim 3, wherein the noise spectrum data includes a noise spectrum of a vehicle that is being driven.

5. The audio apparatus according to claim 3, wherein the threshold value for each frequency band is an average of noise levels in the frequency band of the noise spectrum data.

6. An audio apparatus for correcting an audio signal in response to a noise level, the audio apparatus comprising:

a correction unit configured to correct an input audio signal on the basis of a weighting factor;

an output unit that produces a played-back audio sound on the basis of the corrected input audio signal;

a microphone for receiving an external sound, which includes the played-back audio sound and a noise signal, the nose signal including a speech signal;

a noise-extracting unit configured to extract the noise signal from the external sound detected by the microphone, the noise-extracting unit including:

an audio-cancelling unit configured to remove the input audio signal from the played-back audio sound and noise signal;

a speech-determining unit configured to identify and isolate the speech signal included in the noise signal on the basis of predetermined noise spectrum data, which corresponds to a noise spectrum of vehicle noise present in a vehicle cabin;

a speech-removing unit configured to eliminate the speech signal from the noise signal having a plurality of frequency bands thereby generating an extracted noise signal free of the speech signal, wherein a lower frequency band and an adjacent upper frequency band form a frequency band pair;

the speech-determining unit configured to compare noise signal levels in the lower frequency band and the upper frequency band of each of a plurality of frequency band pairs, so as to determine if the noise signal includes the speech signal; and a weighting factor calculation unit configured to calculate the weighting factor on the basis of the extracted noise signal, and configured to supply the calculated weighting factor to the correction unit;

wherein and if speech-determining unit determines that the difference in the respective noise levels in a frequency band pair is greater than a noise difference threshold value, the noise signal is replaced with the noise difference threshold value.

7. The audio apparatus according to claim 6, wherein the threshold value is set for individual frequency bands of the noise spectrum data.

8. The audio apparatus according to claim 7, wherein the noise spectrum data includes a noise spectrum of a vehicle that is being driven.

9. The audio apparatus according to claim 7, wherein the threshold value for each frequency band is an average of noise levels in the frequency band of the noise spectrum data.

10. A method for playing back an audio signal in an in-vehicle audio apparatus, the method comprising:

receiving an external sound that includes a played-back audio sound and a noise signal, the noise signal including a speech signal, the external sound received by a microphone in a vehicle interior space;

extracting the noise signal from the external sound detected by the microphone;

extracting the input audio signal from the played-back audio sound and noise signal eliminating the speech signal from the extracted noise signal with reference to predetermined noise spectrum data thereby generating an extracted noise signal free of the speech signal, the noise spectrum data having a plurality of frequency bands corresponding to vehicle noise present in a vehicle cabin, wherein a lower frequency band and an adjacent upper frequency band form a frequency band pair;

calculating a weighting factor corresponding to the extracted noise signal, from which the speech signal is removed;

comparing noise signal levels in the lower frequency band and the upper frequency band of each of a plurality of frequency band pairs, and if the difference in the respective noise levels in a frequency band pair is greater than a noise difference threshold value, replacing the noise signal with the noise difference threshold value so as to eliminate the speech signal from the noise signal in the frequency band pair;

correcting the audio signal on the basis of the calculated weighting factor; and producing the played-back audio sound on the basis of the corrected audio signal.

11. The method according to claim 10, wherein the act of removing the speech signal from the noise signal comprises comparing a threshold value generated from the noise spectrum data and the noise signal, and determining that the noise signal includes the speech signal and replacing the noise signal with the threshold value when the noise signal exceeds the threshold value.

12. The method according to claim 11, wherein the noise spectrum data includes a noise spectrum of a vehicle that is being driven, and the threshold value is generated for individual predetermined frequency bands on the basis of the noise spectrum of a vehicle.

* * * * *